United States Patent [19]

Craib

[11] 4,160,350

[45] Jul. 10, 1979

[54] FLOOR JOIST PLATE

[76] Inventor: Rupert G. Craib, 45654 Sherri Ct., Mt. Clements, Mich. 48044

[21] Appl. No.: 921,280

[22] Filed: Jul. 3, 1978

[51] Int. Cl.[2] ..... E04C 3/12

[52] U.S. Cl. ..... 52/696; 85/13; 403/405

[58] Field of Search ..... 52/634, 644, 693, 696, 52/694; 85/13; 403/385, 389, 398, 399, 405

[56] References Cited

U.S. PATENT DOCUMENTS

| | | | |
|---|---|---|---|
| 3,298,151 | 1/1967 | Jureit | 52/644 |
| 3,503,173 | 3/1970 | Jureit | 52/693 X |
| 3,651,612 | 3/1972 | Schmitt | 52/693 |
| 3,708,942 | 1/1973 | Leonard | 52/693 X |
| 4,078,352 | 3/1978 | Knowles | 52/696 |
| 4,096,670 | 6/1978 | Fuller | 52/696 X |

*Primary Examiner*—J. Karl Bell

*Attorney, Agent, or Firm*—Cullen, Sloman, Cantor, Grauer, Scott & Rutherford

[57] ABSTRACT

A floor joist formed of a pair of parallel wood chords, such as 2×4's, which are spaced apart and interconnected by sheet metal plates. The plate is normally vertically arranged and its upper and lower edge portions are slit and bent into alternatingly opposed legs having a horizontal wood engaging support portion and a vertical connector portion for overlapping the wood strip vertical faces. The central portion of the sheet forms a pre-sized spacer for fitting between the two wood chords. Thus, each connector plate forms upwardly and downwardly channel-like formations to each receive a chord, with a central spacer portion for maintaining the spacing between the chords. The leg connector portions are formed with struck-out teeth which are embedded into the wood chords for providing the complete joist assembly.

5 Claims, 5 Drawing Figures

FLOOR JOIST PLATE

BACKGROUND OF INVENTION

Floor joists and roof joists have conventionally been made of large wood beams, such as 4×8, 2×6, 2×10, etc., nominal dimensions. Since large wood pieces of good quality are becoming more expensive and less available, efforts have been made to form such joists out of pairs of smaller cross-sectional wood members which are interconnected by metal connectors of various types to form a composite wood chord-metal connector joist in a truss-like shape.

Thus, the invention herein relates to an improved metal connector plate for interconnecting wood strips or chords to form a truss-like elongated joist comparable in size and shape to conventional wood beams.

SUMMARY OF INVENTION

The invention herein contemplates a connector plate for interconnecting and holding in space relationship a pair of parallel elongated wood strips which form upper and lower chords of a truss-like joist. The connector plates are each formed of a flat, stiff sheet metal piece which is vertically arranged and bent into a central web portion and upper and lower leg portions. The central portion is roughly rectangular in shape and of a size to provide the predetermined space between the wood chords. The upper and lower legs are formed with a horizontal portion and a vertical portion, with the legs alternating in direction of extension from the web so that the web is centered along the horizontal axis of the chords and the chords are received within the channel or U-shaped like configuration formed by the adjacent upper and lower legs. The vertical portion of each leg is provided with struck-out spikes or teeth, similar in arrangement to conventional connector plates used in fabricating trusses, so that the legs may be bent towards the chords which are arranged between the legs for embedding the teeth and thereby joining the metal plates to the wood chords.

A number of connector plates may be provided for each joist. For example, the plates may be spaced apart 18" along the lengths of the chords so that the final assembly consists of spaced apart wood members or chords and horizontally spaced apart connectors interconnecting them to form the unitary assembly.

An advantage of this construction is that the plates may be formed of relatively inexpensive metal sheets which are pre-slit and bent into the upper and lower channel-like configuration with the interconnecting pre-size web spacer portion. The plates may be easily applied to the space chord members when the assembly is performed by simply bending opposing pairs of legs towards each other for embedding their teeth into the wood members. Thus, the assembly is relatively inexpensive and simple and requires simple equipment. Yet the strength of the assembly should be comparable to, if not better than, large wood beams.

Yet another object of this invention is to permit the use of relatively inexpensive smaller cross-sectional wood strips to provide the equivalent of a large cross-sectional beam, thereby making it possible to reduce overall costs of contruction of a floor or roof structure portion.

These and other objects and advantages of this invention will become apparent upon reading the following description, of which the attached drawings form a part.

DETAILED DESCRIPTION

Figure 1:
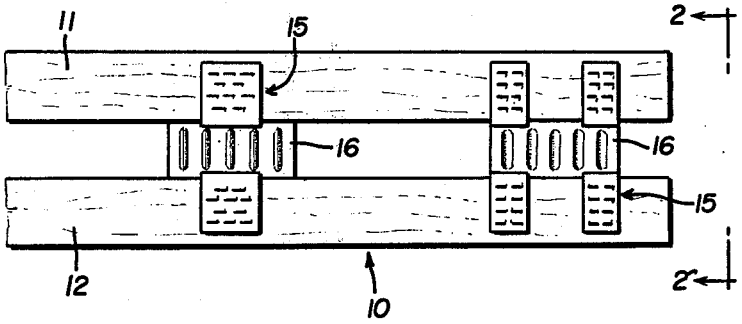
FIG. 1 is an elevational view of one end of a joist illustrating the invention herein.
Figure 2:
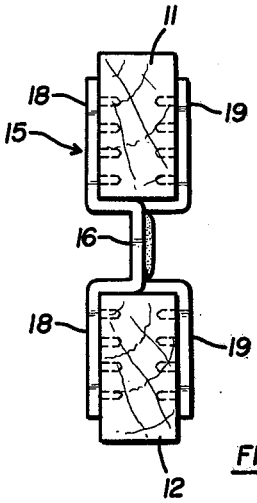
FIG. 2 is an end view, to an enlarged scale, taken in the direction of arrows 2—2 of the joist of FIG. 1.

FIG. 1 illustrates a portion of a joist 10 formed of an upper chord 11, a lower chord 12, and a number of connector plates 15. The chords may be formed of conventional wood lumber pieces, such as 2×4's or the like. They are spaced apart, one above the other, in parallelism in order to make up the equivalent of a large cross-sectional beam.

Figure 3:
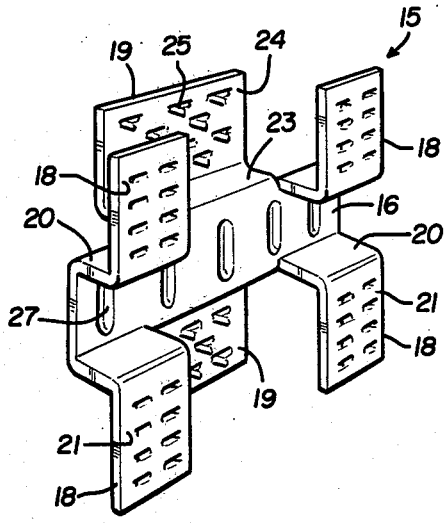
FIG. 3 is an enlarged, perspective view of a connector plate.
Figure 4:
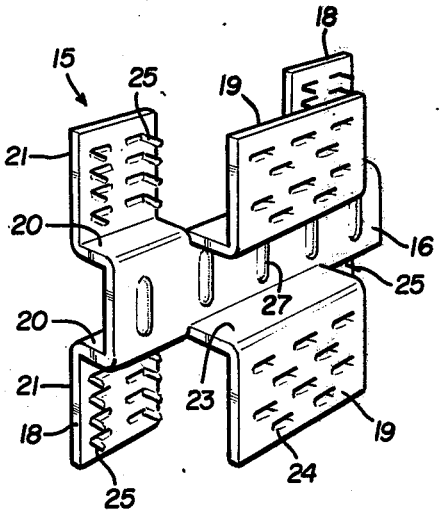
FIG. 4 is a view similar to FIG. 3, but showing the opposite side or face of the connector plate.

The connector plates 15 are each formed of a stiff metal sheet, such as 18 gauge steel, which is slit and bent into the shape illustrated in FIGS. 3 and 4. That is, the sheet is arranged vertically in normal use, so that its upper and lower edge portions are each provided with three parallel slits to form a roughly horizontally elongated, vertically arranged spacer or web section 16 with pairs of upper and lower end legs 18 and central legs 19.

Each end leg is formed with a horizontal bent spacer portion 20 arranged approximately perpendicular to the web section 16, and a vertical connector portion 21. Likewise, the central legs are each provided with a horizontal spacer portion 23 and vertical connector portions 24.

Each of the connector portions of each of the legs is provided with numerous struck-out teeth 25. This form of teeth is conventional in connector plates used in forming trusses. Essentially they are formed by striking out slit portions of the plate into a tooth-like configuration arranged roughly perpendicular to the plane of the plate. The sizes and shapes of these forms of teeth may be varied as is within the knowledge of those skilled in the art in the formation of truss connector plates and since they form no part of the invention herein, no further description thereof is given. It is enough that one or another of the conventional forms of teeth are provided by striking out portions of the connector plates in a manner similar to those formed on conventional truss connector plates.

The central spacer or web section 16 is preferably provided with a number of bent ribs or corrugations 27 for stiffening or reinforcing the metal, particularly in the vertical direction.

Figure 5:
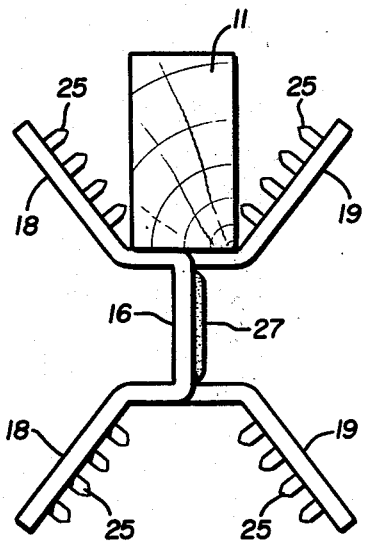
FIG. 5 is an enlarged end view of a connector plate with its legs bent apart and with a wood strip arranged in position for connection to the plate.

In order to form a complete joist, a number of connectors are used. Preferably they are turned in an alternating fashion, as illustrated in FIG. 1 so that each adjacent connector is opposite in directional alignment relative to the next one. The wood strips or chords are arranged within the channel-like shapes formed at the upper and lower edges of each connector. Preferably the legs are originally bent at an angle as illustrated in FIG. 5 so that the wood strips can be arranged between the legs either by holding the connectors vertically or preferably by arranging the connectors and the wood strips side by side in a horizontal plane. Then, the legs are pressed towards each other as for example by use of a roller or press to squeeze the teeth into the vertical faces of the wood chords whose horizontal or facing sides are rested and supported upon the support or horizontal parts of each leg.

Once the legs are squeezed together so that their teeth embed within the wood chords, the joist forms a rigid assembly with the chords spaced apart the predetermined distance corresponding to the height of the web sections 16.

Having fully described an operative embodiment of this invention, I now claim:

1. In a joist formed of a pair of horizontally arranged, vertically spaced apart, parallel wood strips, as for example wood 2×4's, and connector plates rigidly interconnecting and relatively positioning these strips, an improved connector plate comprising:

said connector plate being formed of an initially flat, thin, stiff metal sheet having a central, roughly rectangular shaped spacer web section arranged in the vertical plane between the facing edges of the wood strips;

the upper and lower portions of the sheet, i.e., the portions above and below said section, each being vertically slit to form separate upper and lower legs, each integrally joined to its respective upper and lower section edge;

at least one of the upper legs and at least one of the lower legs being bent horizontally to form a horizontal support portion, and then being bent vertically to form a vertical connector portion, with the horizontal support portion arranged to engage the facing edge of its adjacent wood strip for holding and spacing the strips, and all of the legs having connector portions overlapping the parallel vertical faces of said strips, with the connector portions of adjacent legs being alternately arranged on the opposite faces of its respective wood strip so that the wood strip is closely received in a channel-like holder formed by the adjacent legs at each of the upper and lower edges of the spacer web section;

and means formed on the leg connector portions for mechanically fastening them to the wood strips.

2. A construction as defined in claim 1, and each of the adjacent legs having a horizontally bent support portion extending in the opposite direction, so that the web section is located in a vertical plane which is approximately centered upon the horizontal central axes of the wood strips.

3. A construction as defined in claim 1, and including a number of struck-out teeth formed on each of the leg connector portions, and with each of said leg connector portions being originally bent outwardly at an acute angle relative to the web section so that they diverge apart from opposing legs and each leg connector being bendable towards its opposing leg connector portion;

wherein the wood strips may be positioned between opposing pairs of leg connector portions and thereafter said leg connector portions may be bent towards each other for embedding their teeth into the wood strips for thereby interconnecting the twc.

4. A construction as defined in claim 3, and such sheet being provided with two vertical slits in each of its upper and lower edge portions to form an upper and lower central leg and two pairs of legs on each of the opposite ends of the web section, with the end legs all being bent in the same direction relative to the web section and the central legs being bent in the opposite direction for forming upper and lower channel-like configurations on each connector.

5. A construction as defined in claim 4 and including a plurality of horizontally spaced apart, roughly parallel, vertically elongated ribs formed in the web section.

* * * * *